US007525251B2

(12) United States Patent
Kim

(10) Patent No.: US 7,525,251 B2
(45) Date of Patent: Apr. 28, 2009

(54) STRUCTURE OF BARRIER RIBS FOR PLASMA DISPLAY PANEL AND PLASMA DISPLAY PANEL HAVING THE SAME

(75) Inventor: Se-Jong Kim, Suwon-si (KR)

(73) Assignee: Samsung SDI Co., Ltd., Suwon-si (KR)

( * ) Notice: Subject to any disclaimer, the term of this patent is extended or adjusted under 35 U.S.C. 154(b) by 396 days.

(21) Appl. No.: 11/372,886

(22) Filed: Mar. 10, 2006

(65) Prior Publication Data

US 2006/0202619 A1 Sep. 14, 2006

(30) Foreign Application Priority Data

Mar. 11, 2005 (KR) ..... 10-2005-0020566

(51) Int. Cl.
*H01J 17/49* (2006.01)
*H01J 1/88* (2006.01)

(52) U.S. Cl. ..... 313/582; 313/292

(58) Field of Classification Search ..... 313/582–584, 313/292

See application file for complete search history.

(56) References Cited

U.S. PATENT DOCUMENTS

2004/0075389 A1 4/2004 Kim et al.
2005/0242728 A1 * 11/2005 Song et al. ..... 313/583

FOREIGN PATENT DOCUMENTS

JP 2004-055495 2/2004
JP 2004-103419 4/2004
JP 2004-214166 7/2004
JP 2006-004670 1/2006
JP 2006-134862 5/2006
JP 2006-261106 9/2006
JP 2006-294587 10/2006
KR 10-2005-0011267 A 1/2005
KR 2005-011267 A * 1/2005

OTHER PUBLICATIONS

Notice to Submit Response by Korean Intellectual Property Office on Jul. 31, 2006.

* cited by examiner

*Primary Examiner*—Karabi Guharay
(74) *Attorney, Agent, or Firm*—Knobbe Martens Olson & Bear LLP

(57) ABSTRACT

A structure of barrier ribs of a plasma display panel (PDP) which reduces noise and vibration generated when operating the PDP as well as easily performs a test to find defective barrier ribs during manufacturing the PDP, and a PDP including the barrier ribs are disclosed. In one embodiment, the barrier ribs include: i) main barrier ribs partitioning display discharge cells disposed in a display region at which an image is displayed, ii) first dummy barrier ribs disposed adjacent to the display discharge cells in a non-display region at which an image is not displayed, partitioning first non-display discharge cells having the same structure as the display discharge cells and iii) second dummy barrier ribs disposed adjacent to the first non-display discharge cells in a non-display region partitioning second non-display discharge cells having a different structure from the display discharge cells.

23 Claims, 3 Drawing Sheets

STRUCTURE OF BARRIER RIBS FOR PLASMA DISPLAY PANEL AND PLASMA DISPLAY PANEL HAVING THE SAME

CROSS-REFERENCE TO RELATED PATENT APPLICATION

This application claims the priority of Korean Patent Application No. 10-2005-0020566, filed on Mar. 11, 2005 in the Korean Intellectual Property Office, the disclosure of which is incorporated herein in its entirety by reference.

This application also relates to U.S. patent application Ser. No. 10/654,194 entitled "Plasma display panel having dummy barrier ribs," filed on Sep. 3, 2003, which is incorporated by reference.

BACKGROUND OF THE INVENTION

1. Field of the Invention

The present invention relates to a plasma display panel (PDP), and more particularly, to a structure of barrier ribs of a PDP which reduces noise and vibration generated during operating the PDP, and a PDP having the barrier ribs.

2. Description of the Related Technology

Recently, PDPs have recently attracted much attention as a replacement for conventional cathode ray tube (CRT) display devices. In PDPs, a discharge gas is sealed inside two substrates on which a plurality of electrodes are formed, a discharge voltage applied to the electrodes, and ultraviolet (UV) radiation generated by the discharge excites a phosphor material formed in a predetermined pattern to form a desired image.

Such PDPs use a discharge mechanism, which emits light by applying a high voltage inside discharge cells and causing discharge. Shock waves are generated by the discharge inside the discharge cells. These shock waves hit barrier ribs partitioning the discharge cells, thereby causing noise and vibration.

FIG. 1 is a schematic view of a portion of a PDP including a front substrate 11 and a rear substrate 12 at which noise and vibration occur most.

As illustrated in FIG. 1, noise and vibration occur most at edges 20 of the PDP. The edges 20 almost coincide with areas at which dummy barrier ribs are disposed to prevent edge effects of non-uniform discharge. U.S. patent application Ser. No. 10/654,194, published on Apr. 22, 2004, discloses a general concept of dummy barrier ribs, and thus detailed description thereof will be omitted.

Therefore, structures of the dummy barrier ribs and barrier ribs adjacent to the dummy barrier ribs have a close correlation with generating and reducing noise and vibration. A conventional PDP failed to include barrier ribs structured to efficiently reduce noise and vibration of the edges 20, and thus, reducing product values and weakening product competitiveness.

SUMMARY OF CERTAIN INVENTIVE ASPECTS

One aspect of the present invention provides a structure of barrier ribs of a PDP that can reduce noise and vibration during operating the PDP, and a PDP including the barrier ribs.

Another aspect of the present invention provides a structure of barrier ribs of a PDP through which testing of defective barrier ribs can be easily performed during manufacturing the PDP, and a PDP including the barrier ribs.

Another aspect of the present invention provides a structure of barrier ribs of a PDP, including: i) main barrier ribs partitioning display discharge cells disposed in a display region at which an image is displayed, ii) first dummy barrier ribs disposed adjacent to the display discharge cells in a non-display region at which the image is not displayed, partitioning first non-display discharge cells having the same structure as the display discharge cells, and iii) second dummy barrier ribs disposed adjacent to the first non-display discharge cells in the non-display region at which the image is not displayed, partitioning second non-display discharge cells having a different structure from the display discharge cells.

In one embodiment, the first non-display discharge cells partitioned by the first dummy barrier ribs may be disposed in a single row and be adjacent to the display discharge cells partitioned by the main barrier ribs.

In one embodiment, the second non-display discharge cells partitioned by the second dummy barrier ribs may be disposed in a plurality of rows.

In one embodiment, cross-sections of the display discharge cells partitioned by the main barrier ribs may be octagonal.

Another aspect of the present invention provides a PDP including: i) a front substrate and a rear substrate disposed to face each other, edges of which are sealed together, and divided into a display region at which an image is displayed and a non-display region at which the image is not displayed, ii) main barrier ribs partitioning display discharge cells disposed in the display region, iii) first dummy barrier ribs disposed adjacent to the display discharge cells in the non-display region, partitioning first non-display discharge cells having the same structure as the display discharge cells, iv) second dummy barrier ribs disposed adjacent to the first non-display discharge cells in the non-display region, partitioning second non-display discharge cells having a different structure from the display discharge cells and discharge electrodes disposed between the front substrate and the rear substrate, causing discharge at least inside the display discharge cells partitioned by the main barrier ribs.

BRIEF DESCRIPTION OF THE DRAWINGS

Embodiments of the present invention will be described with reference to the attached drawings.

DETAILED DESCRIPTION OF CERTAIN INVENTIVE EMBODIMENTS

Figure 1:
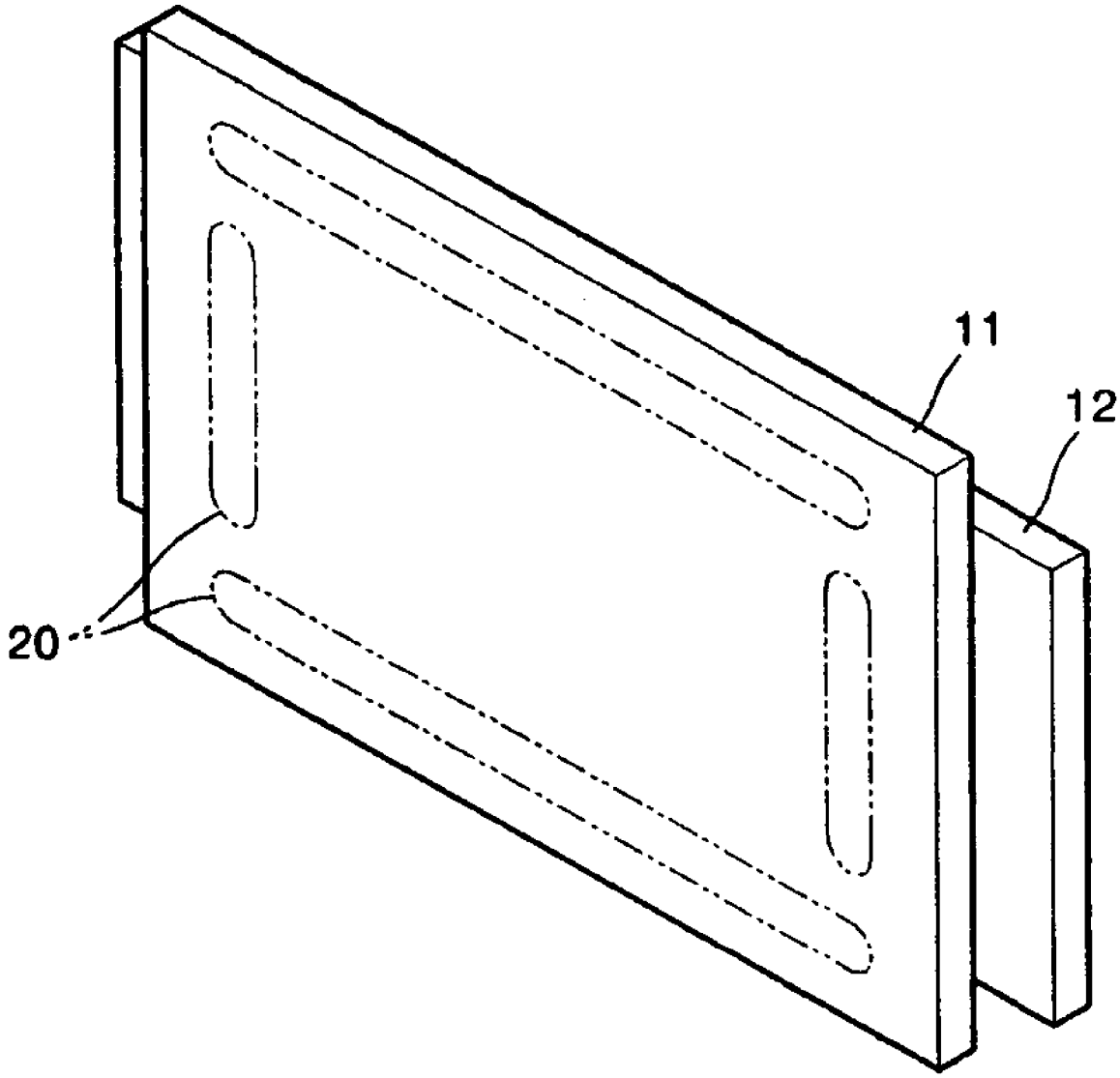
FIG. 1 is a schematic perspective view of a portion of a PDP at which noise and vibration occur most.
Figure 2:
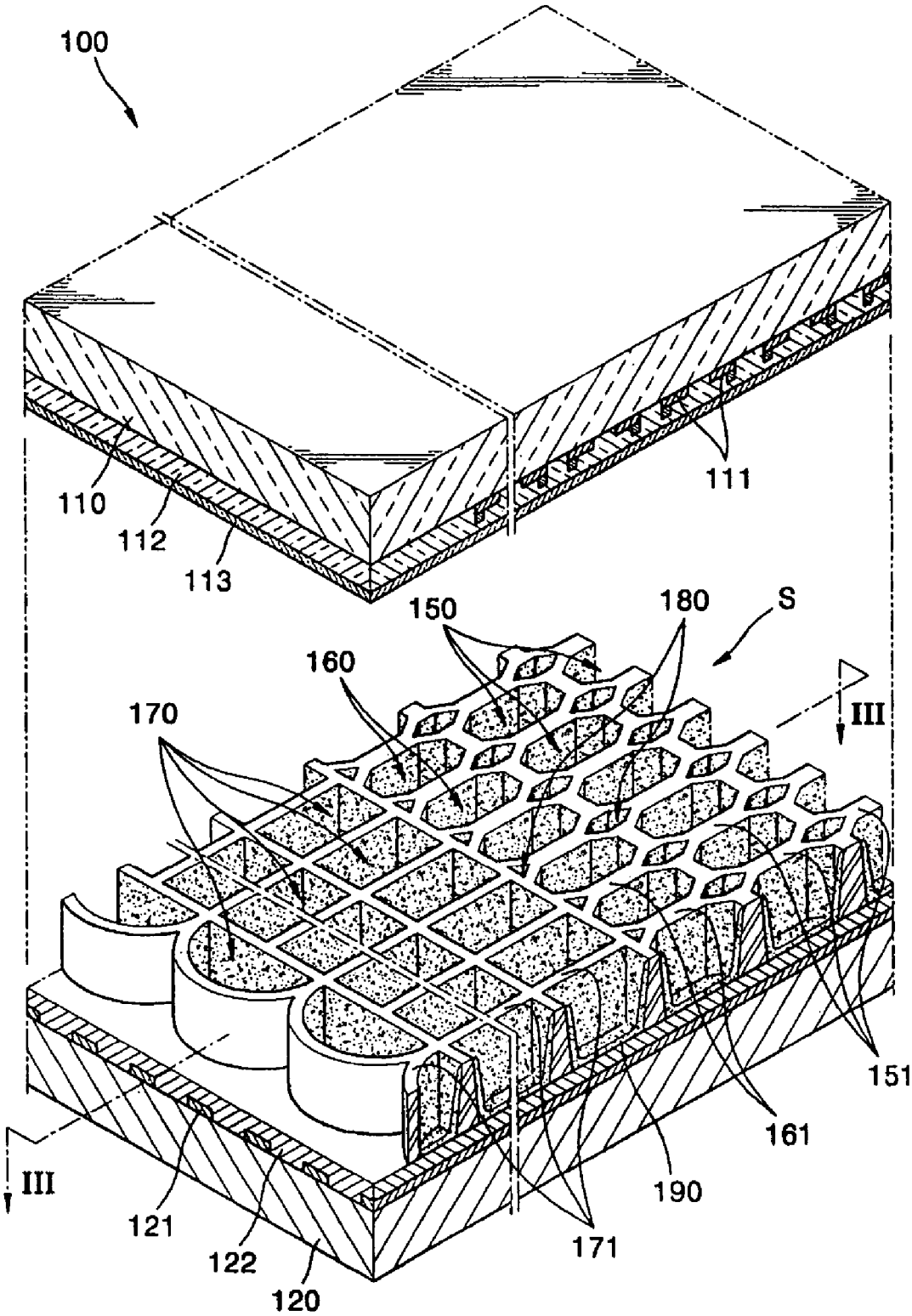
FIG. 2 is a partially-exploded perspective view of a PDP according to an embodiment of the present invention.
Figure 3:
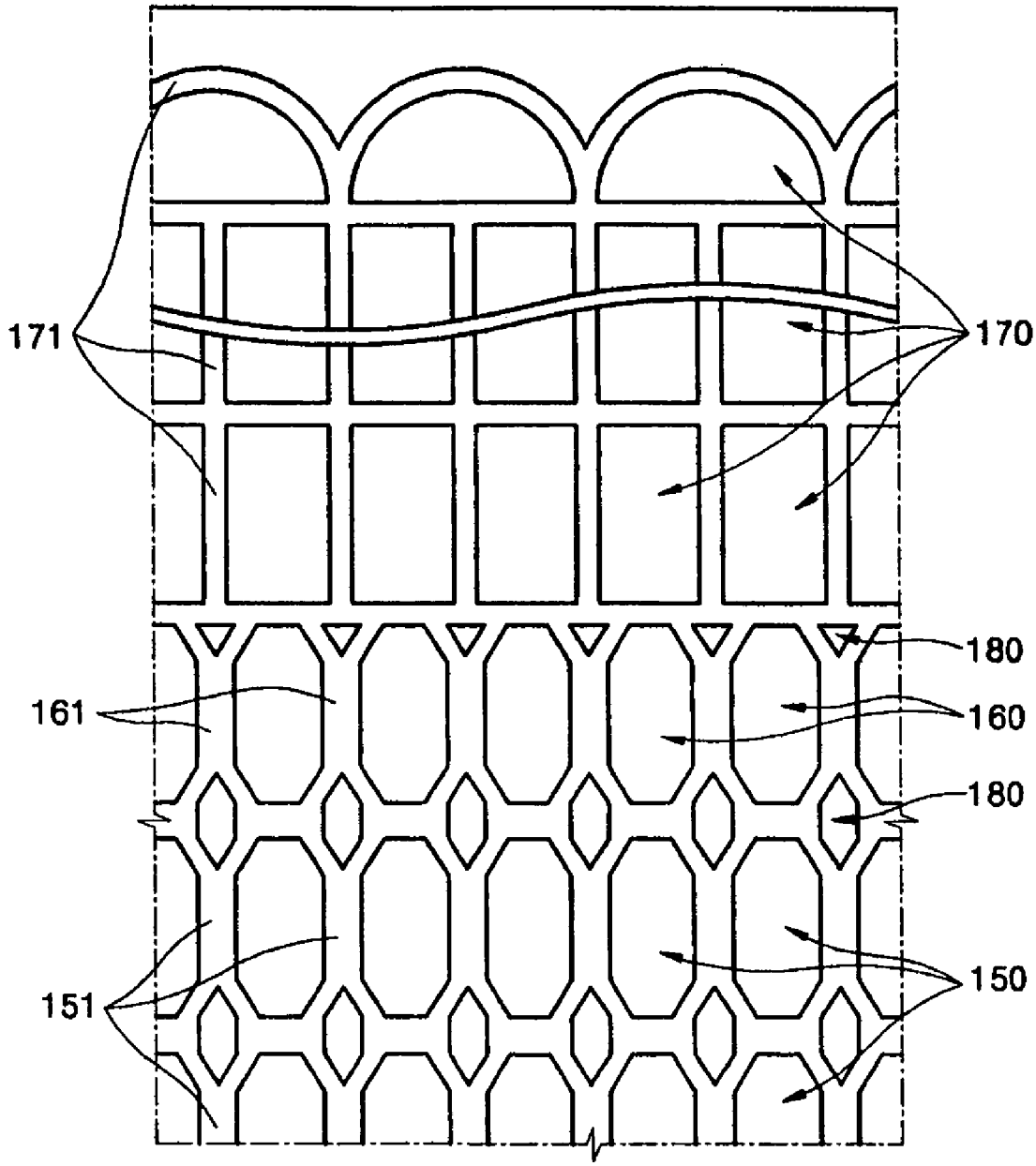
FIG. 3 is a cross-sectional view of the PDP taken along the line III-III in FIG. 2.

FIG. 2 is a partially-exploded perspective view of a PDP 100 according to an embodiment of the present invention, and FIG. 3 is a cross-sectional view of the PDP 100 taken along the line III-III in FIG. 2.

Referring to FIGS. 2 and 3, the PDP 100 includes a front substrate 110 and a rear substrate 120 disposed to face each other at a predetermined distance, and a discharge space S is formed between the front substrate 110 and the rear substrate 120. The discharge space S is filled by a discharge gas such as Ne or Xe. Edges of the front and rear substrates 110 and 120 are sealed by a sealing material such as frit glass.

A plurality of pairs of sustain electrodes 111 are formed on a surface of the front substrate 110. Pairs of the sustain electrode 111 include an X electrode, which is a common electrode, and a Y electrode, which is a scan electrode.

A first dielectric layer 112 is formed to cover the sustain electrodes 111, and a protective layer 113 made of, for example, MgO, is formed to cover the first dielectric layer 112. The protective layer 113 also acts a cathode during discharge.

Address electrodes 121 are formed on a surface of the rear substrate 120 to perpendicularly cross the sustain electrodes 111.

The structures and patterns of the sustain electrodes 111 and the address electrodes 121 can be altered in many ways depending on design conditions.

A second dielectric layer 122 is formed to cover the address electrodes 121 on the rear substrate 120. The second dielectric layer 122 may be white so that the overall luminance of the PDP 100 can be improved.

Discharge cells are divided into display discharge cells 150 located at display regions where images are displayed by plasma discharge, and first and second non-display discharge cells 160 and 170 located at non-display regions where images are not displayed. Generally, the non-display regions are located outside the display regions, for example, edges of the display regions.

In one embodiment, barrier ribs which partition the discharge cells are formed on the second dielectric layer 122. In one embodiment, the barrier ribs are divided into main barrier ribs 151 partitioning the display discharge cells 150, and first and second dummy barrier ribs 161 and 171 partitioning the first and second non-display discharge cells 160 and 170, respectively.

The display discharge cells 150, which are partitioned by the main barrier ribs 151, are located at the center of the PDP 100 and produce images through discharge.

In one embodiment, as shown in FIGS. 2 and 3, the first non-display discharge cells 160, which are partitioned by the first dummy barrier ribs 161, are located adjacent to the display discharge cells 150. In one embodiment, the first non-display discharge cells 160 are in a single row.

In one embodiment, as shown in FIGS. 2 and 3, the second dummy barrier ribs 171 are disposed adjacent to the first dummy barrier ribs 161 on their outer circumference. In one embodiment, the second non-display discharge cells 170, which are partitioned by the second dummy barrier ribs 171, are formed in, for example, three to four rows.

In one embodiment, the display discharge cells 150 and the first non-display discharge cells 160 are formed in continuous, for example, octagonal cross-sections. In this embodiment, non-discharge regions 180 are formed around the display discharge cells 150 and the first non-display discharge cells 160 as shown in FIGS. 2 and 3. In another embodiment, cross-sections of the cells 150 and 160 may have different shapes such as circle, pentagon or hexagon, as long as they are different from those of the second non-display discharge cells 170.

In one embodiment, the cross-sections of the second non-display discharge cells 170, which are partitioned by the second dummy barrier ribs 171, are quadrangular and semicircular, different from the cross-sections of the display discharge cells 150 and the first non-display discharge cells 160.

In one embodiment of the present invention, the above different structure provides the following advantage.

When a discharge occurs in the display discharge cells 150, which are partitioned by the main barrier ribs 151, noise and vibration caused by the discharge are transmitted to the second dummy barrier ribs 171 via the first dummy barrier ribs 161. If the structures of the display discharge cells 150 and the first non-display discharge cells 160 were the same as the structure of the second non-display discharge cells 170, the natural frequencies of the cells 150-170 would be the same. Thus, a resonance would occur in those cells 150-170, resulting in amplifying the transmitted noise and vibration. In one embodiment, since the structure of the second non-display discharge cells 170 is different from those of the cells 150 and 160, such a resonance is prevented.

In one embodiment, the structure of the display discharge cells 150 is the same as that of the first non-display discharge cells 160, and the same structure provides the following advantage.

Generally, a test for detecting defective barrier ribs in a manufacturing process of a PDP is performed by designating a discharge cell of an adjacent row as a reference cell and then comparing a barrier rib of the reference cell with a barrier rib of a discharge cell to be tested.

Referring to FIGS. 2 and 3, when the main barrier rib 151 disposed at the farthest edge from the center is tested, the first non-display discharge cell 160 disposed adjacent to the display discharge cell 150 at the farthest edge is a reference cell. Therefore, if the structure of the first non-display discharge cell 160 were different from that of the display discharge cell 150, it would be very difficult to test whether or not the main barrier rib 151 disposed at the farthest edge is defective or not. This is because the display discharge cells 150 disposed at the farthest edges would not have appropriate reference cells to perform a defective test.

Consequently, detecting a defective main barrier rib 151 can be easily performed.

Meanwhile, phosphor layers 190 are formed on inner walls of the main barrier ribs 151, the first dummy barrier ribs 161, and the second dummy barrier ribs 171, and on top of the second dielectric layer 122 surrounded by the main barrier ribs 151, and first and second dummy barrier ribs 161 and 171.

The phosphor layers 190 include components which generate visible light by ultraviolet (UV) radiation. Red phosphor layers formed in red light emitting discharge cells include phosphor such as Y (V, P) $O_4$:Eu, green phosphor layers formed in green light emitting discharge cells include phosphor such as $Zn_2SiO_4$:Mn, and blue phosphor layers formed in blue light emitting discharge cells include phosphor such as BAM:Eu.

The process of transmitting noise and vibration generated during operating the PDP 100 is described below.

First, when a voltage is supplied to the PDP 100 from an external power source, an address discharge occurs, following by a sustain discharge. UV radiation is emitted as the energy level of the discharge gas excited when the sustain discharge occurs is lowered, thereby exciting the phosphor layers 190 formed inside the discharge cells. Visible light is emitted as the energy level of the excited phosphor layers 190 is lowered, and the emitted visible radiation transmits through the front substrate 110 to form an image recognizable by users.

In the operating process as described above, shock waves are generated inside the display discharge cells 150 in which discharge occurs. The shock waves hit the main barrier ribs 151 of the display discharge cells 150, and thus cause noise and vibration. The generated noise and vibration are transmitted to the first dummy barrier ribs 161, and then to the second dummy barrier ribs 171.

In one embodiment, as discussed above, although the cross-sections of the first non-display discharge cells 160 are octagonal, the cross-sections of the second non-display discharge cells 170 are quadrangular. Thus, they have different natural frequencies. As a result, the noise and vibration generated in the main barrier ribs 151 and transmitted to the first dummy barrier ribs 161 are not amplified by resonance, instead they are significantly reduced, in the process of being transmitted to the second dummy barrier ribs 171.

In one embodiment, a structure of barrier ribs and a PDP including the barrier ribs achieve various effects including the following.

Since the structures of first and second non-display discharge cells are different, amplification due to resonance of noise and vibration caused by discharge is prevented.

In addition, since the structures of the display discharge cells and the first non-display discharge cells are the same, defective main barrier ribs can be easily detected during a manufacturing process of the PDP.

While the above description has pointed out novel features of the invention as applied to various embodiments, the skilled person will understand that various omissions, substitutions, and changes in the form and details of the device or process illustrated may be made without departing from the scope of the invention. Therefore, the scope of the invention is defined by the appended claims rather than by the foregoing description. All variations coming within the meaning and range of equivalency of the claims are embraced within their scope.

What is claimed is:

1. A barrier rib structure for a plasma display panel (PDP), comprising:

a plurality of main barrier ribs partitioning display discharge cells, wherein main barrier ribs are located in a display region in which an image is configured to be displayed;

a plurality of first dummy barrier ribs formed adjacent to the display discharge cells in a non-display region in which an image is not displayed, wherein the first dummy barrier ribs partition first non-display discharge cells having substantially the same structure as that of the display discharge cells; and a plurality of second dummy barrier ribs formed adjacent to the first non-display discharge cells in the non-display region but not adjacent to the display discharge cells, wherein the second dummy barrier ribs partition second non-display discharge cells having a different structure from that of the display discharge cells, wherein the second non-display discharge cells are formed in a plurality of rows, and wherein each row comprises a plurality of non-display discharge cells which are substantially the same shape.

2. The structure of the barrier ribs of claim 1, wherein the first non-display discharge cells are formed in a single row and contact the display discharge cells.

3. The structure of the barrier ribs of claim 1, wherein cross-sections of the display discharge cells are octagonal.

4. The structure of the barrier ribs of claim 1, wherein the size of at least one of the second non-display discharge cells is greater than that of each of the first non-display discharge cells.

5. A plasma display panel (PDP), comprising:

a front substrate and a rear substrate opposing each other, wherein i) a display region in which an image is configured to be displayed and ii) a non-display region in which an image is not displayed are defined between the front and rear substrates;

a plurality of main barrier ribs partitioning display discharge cells formed in the display region;

a plurality of first dummy barrier ribs formed adjacent to the display discharge cells in the non-display region, wherein the first dummy barrier ribs partition first non-display discharge cells having substantially the same structure as that of the display discharge cells;

a plurality of second dummy barrier ribs formed adjacent to the first non-display discharge cells in the non-display region, wherein the second dummy barrier ribs partition second non-display discharge cells having a different structure from that of the display discharge cells, wherein the second non-display discharge cells are formed in a plurality of rows, and wherein each row comprises a plurality of non-display discharge cells which are substantially the same shape; and a plurality of discharge electrodes formed between the front substrate and the rear substrate, causing discharge at least inside the display discharge cells.

6. The PDP of claim 5, wherein the first non-display discharge cells contact the display discharge cells.

7. The PDP of claim 5, wherein the first non-display discharge cells are formed in a single row.

8. The PDP of claim 5, wherein the second non-display discharge cells contact the first non-display discharge cells.

9. The PDP of claim 5, wherein cross-sections of the first non-display discharge cells are octagonal.

10. The PDP of claim 5, wherein the second non-display discharge cells include i) a plurality of first rows of non-display discharge cells contacting the first non-display discharge cells and ii) at least one row of non-display discharge cells extending from the plurality of first rows, and wherein cross-sections of the plurality of first rows are quadrangular and cross-sections of the at least one row are semi-circular.

11. The PDP of claim 5, wherein the size of at least one of the second non-display discharge cells is greater than that of each of the first non-display discharge cells.

12. A structure for a plasma display panel (PDP), comprising:

a plurality of first non-display discharge cells formed in a non-display region in which an image is not displayed, wherein the first non-display discharge cells contact display discharge cells and have substantially the same structure as that of the display discharge cells; and a plurality of second non-display discharge cells formed in the non-display region and contacting the first non-display discharge cells, wherein the second non-display discharge cells have a different structure from that of the display discharge cells, wherein the second non-display discharge cells are formed in a plurality of rows, and wherein each row comprises a plurality of non-display discharge cells which are substantially the same shape.

13. The structure of claim 12, further comprising first dummy barrier ribs partitioning the first non-display discharge cells.

14. The structure of claim 12, further comprising second dummy barrier ribs partitioning the second non-display discharge cells.

15. The structure of claim 12, wherein the first non-display discharge cells are formed in a single row.

16. The structure of claim 12, wherein cross-sections of the first non-display discharge cells are octagonal.

17. The structure of claim 12, wherein the size of at least one of the second non-display discharge cells is greater than that of each of the first non-display discharge cells.

18. A plasma display panel (PDP), comprising:

two opposing substrates;

a plurality of display discharge cells formed between the substrates and being configured to display an image; and first and second non-display discharge cells formed between the substrates in a region where an image is not displayed, wherein the first non-display discharge cells contact the display discharge cells and have substantially the same structure as that of the display discharge cells, and wherein the second non-display discharge cells contact the first non-display discharge cells and have a different structure from that of the display discharge cells, wherein the second non-display discharge cells are formed in a plurality of rows, and wherein each row comprises a plurality of non-display discharge cells which are substantially the same shape.

19. The PDP of claim 18, wherein cross-sections of the first non-display discharge cells are octagonal.

20. The PDP of claim 18, wherein the second non-display discharge cells include, in order, first, second and third rows of non-display discharge cells, wherein the first row of the second non-display discharge cells contact the first non-display discharge cells, and wherein cross-sections of the first and second rows of the second non-display discharge cells are quadrangular and cross-sections of the third row of the second non-display discharge cells are semi-circular.

21. The PDP of claim 18, wherein the size of at least one of the second non-display discharge cells is greater than that of each of the first non-display discharge cells.

22. A structure for a plasma display panel (PDP), comprising:

a plurality of rows of display discharge cells configured to display an image;

at least one row of first non-display discharge cells which do not display an image and contact the last row of the display discharge cells, wherein each of the first non-display discharge cells is configured to be used as a reference cell to determine a defective barrier rib with respect to each of the last row of the display discharge cells; and a plurality of rows of second non-display discharge cells which do not display an image, wherein the second non-display discharge cells contact the first non-display discharge cells and are configured to reduce noise and vibration transferred from the display discharge cells, and wherein each row of the second non-display discharge cells comprises a plurality of non-display discharge cells which are substantially the same shape.

23. The structure of claim 22, wherein the size of at least one of the second non-display discharge cells is greater than that of each of the first non-display discharge cells.

* * * * *